US010348014B2

(12) United States Patent
Ishii et al.

(10) Patent No.: US 10,348,014 B2
(45) Date of Patent: Jul. 9, 2019

(54) CONNECTOR FOR A FLAT CABLE

(71) Applicant: Molex, LLC, Lisle, IL (US)

(72) Inventors: Akihiro Ishii, Yamato (JP); Kazuya Takahashi, Zama (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/791,113

(22) Filed: Oct. 23, 2017

(65) Prior Publication Data

US 2018/0123273 A1 May 3, 2018

(30) Foreign Application Priority Data

Oct. 31, 2016 (JP) ..... 2016-213289

(51) Int. Cl.

| | |
|---|---|
| ***H01R 13/641*** | (2006.01) |
| ***H01R 12/77*** | (2011.01) |
| ***H01R 13/506*** | (2006.01) |
| ***H01R 12/79*** | (2011.01) |
| *H01R 12/89* | (2011.01) |

(52) U.S. Cl.

CPC ..... *H01R 12/774* (2013.01); *H01R 12/778* (2013.01); *H01R 12/79* (2013.01); *H01R 13/506* (2013.01); *H01R 12/89* (2013.01); *H01R 13/641* (2013.01)

(58) Field of Classification Search

CPC .... H01R 12/59; H01R 12/774; H01R 12/778; H01R 13/506; H01R 12/77; H01R 12/79; H01R 13/641; H01R 12/89

USPC ..... 439/329, 67, 492, 495, 496, 488, 489

See application file for complete search history.

(56) References Cited

U.S. PATENT DOCUMENTS

| | | | | |
|---|---|---|---|---|
| 5,354,214 | A | 10/1994 | Aso et al. | |
| 6,000,950 | A * | 12/1999 | Kajinuma | H01R 12/57 439/496 |
| 6,319,052 | B1 * | 11/2001 | Chang | H01R 12/774 439/260 |
| 7,083,455 | B1 * | 8/2006 | Miura | H01R 12/774 439/260 |
| 7,140,909 | B2 * | 11/2006 | Moritake | H01R 12/774 439/492 |
| 7,427,211 | B2 * | 9/2008 | Yoshikai | H01R 12/79 439/495 |

(Continued)

FOREIGN PATENT DOCUMENTS

| | | |
|---|---|---|
| JP | H03-19185 U | 2/1991 |
| JP | 2005-063842 A | 3/2005 |
| JP | 2006-252975 A | 9/2006 |

*Primary Examiner* — Travis S Chambers

(74) *Attorney, Agent, or Firm* — Molex, LLC

(57) ABSTRACT

A connector has a plurality of terminals aligned in a left/right direction, and a housing that configures a space in which a flat cable can be inserted from a front side to a rear side and holds the terminals on an inside of the space. The housing has two locking convex portions positioned on the inside of the space and in the left/right direction of the terminals, protruding toward an upper side from a lower side, and that catch in notches or holes formed in the left and right sides of the cable. Finally, the housing has a biasing member that is positioned on the inside of the space, formed on an upper side of the space, arranged closer to a center in the left/right direction than the two locking convex portions, and that biases the cable inserted in the space toward a lower side of the space.

20 Claims, 11 Drawing Sheets

(56) References Cited

U.S. PATENT DOCUMENTS

| | | | | |
|---|---|---|---|---|
| 7,540,762 | B2 * | 6/2009 | Lin | H01R 12/89 439/492 |
| 7,559,792 | B2 * | 7/2009 | Lin | H01R 12/774 439/495 |
| 7,833,046 | B2 | 11/2010 | Tamura et al. | |
| 2017/0040725 | A1 * | 2/2017 | Ishii | H01R 12/771 |

* cited by examiner

CONNECTOR FOR A FLAT CABLE

RELATED APPLICATIONS

This application claims priority to Japanese Application No. 2016-213289, filed Oct. 31, 2016, which is incorporated herein by reference in its entirety.

TECHNICAL FIELD

The present disclosure relates to a connector.

BACKGROUND ART

A connector that can be attached to an end part of a flat cable is disclosed in Patent Document 1 described below. The connector described in Patent Document 1 is mounted on a circuit board and electrically connects a flat cable and a circuit board. A plurality of terminals are held, and a space for inserting an end part of the flat cable is provided in a housing (connector body 10 in Patent Document 1) that configures the connector described in Patent Document 1. By inserting a slider (a pressing member in Patent Document 1) on the flat cable inserted inside the space, the end part of the flat cable is pushed against contact points of the terminals, and thus the flat cable and the terminals are electrically connected. Furthermore, two locking convex portions (locking parts 15 in Patent Document 1) protruding along a height direction of the connector are formed inside the space provided inside the connector. The two locking convex portions are positioned to the left and to the right of the plurality of terminals, and each catches in a notch formed in a width direction of the flat cable. Here, a biasing member biases the end part of the flat cable in the directions of the locking convex portions, which thus prevents the flat cable from being pulled out.

Patent Document 1: Japanese Unexamined Patent Application No. 2006-252975

SUMMARY OF THE INVENTION

With the connector described in Patent Document 1, a worker may not be able to recognize that the end part of the flat cable has been inserted in a proper position (more specifically, in a position where the notches on the cable are catching in the locking convex portions of the housing) immediately after the flat cable is inserted. Therefore, the worker could possibly insert the biasing member in a state where the fit between the flat cable and the connector is incomplete (a so-called semi-fitted state).

An object of the present disclosure is to make it easy for a worker to recognize whether a flat cable and a connector are fitted together when inserting a flat cable.

The connector according to the present disclosure has a plurality of terminals aligned in a left to right direction, and a housing formed with a space into which a flat cable can be inserted from a front side to a rear side, and which supports the plurality of terminals, where the housing has a left side locking convex portion positioned on the left side of the plurality of terminals protruding from a lower side to an upper side into which a locking portion formed on the left side of the flat cable catches, a right side locking convex portion positioned on the right side of the plurality of terminals protruding from a lower side to an upper side into which a locking portion formed on the right side of the flat cable catches, and a guide portion protruding from an upper side to a lower side and positioned between the two locking convex portions for guiding the flat cable inserted in the space downward. This enables a worker to easily recognize whether the flat cable and the connector are fitted together.

Furthermore, in an embodiment of the connector, a slanted surface extending obliquely in a rearward and downward direction is formed on the guide portion.

Furthermore, in an embodiment of the connector, the guide portion is positioned further rearward than the two locking convex portions.

Furthermore, in an embodiment of the connector, a first slanted surface extending obliquely rearward and upward is formed on a front side of the housing, and a second slanted surface extending obliquely rearward and upward is formed on a front side of the locking convex portion.

Furthermore, in an embodiment of the connector, a contact that comes into contact with the flat cable inserted in the space is formed on the terminal, and the contact is positioned further rearward than that the second slanted surface formed in the locking convex portion.

Furthermore, in an embodiment of the connector, a slanted surface extending obliquely upward and to the left is formed in a right side surface of the left side locking convex portion, and a slanted surface extending upward and to the right is formed in a left side surface of the right side locking convex portion.

Furthermore, in an embodiment of the connector, the connector also has a slider positioned on a front side of the housing, where the slider is positioned farther frontward than a front side of the space and has a hole through which the flat cable is inserted, a pressing portion that configures an upper side edge of the hole, and a guide portion positioned farther downward than the pressing portion that configures lower side and front side edges of the hole.

Furthermore, in an embodiment of the connector, the pressing portion has a pressing surface that abuts the flat cable and presses the flat cable downward, and two adjacent surfaces positioned on a right side and on a left side, respectively, of the pressing surface and farther upward than the pressing surface, where the two adjacent surfaces are positioned farther upward than the tops of the two locking convex portions.

Furthermore, in an embodiment of the connector, a first slanted surface extending obliquely rearward and upward is formed on a front side of the housing, a second slanted surface extending obliquely rearward and upward is formed on a front side of the locking convex portion of the housing, and a third slanted surface extending obliquely rearward and upward is formed on a rear side of the pressing portion of the slider, where the flat cable is inserted on an inside of the space passing between a space between the first slanted surface and the third slanted surface and a space between the second slanted surface and the third slanted surface.

Furthermore, in an embodiment of the connector, an outer surface concave portion having a cavity and an outer surface convex portion that fits in the cavity in the outer surface concave portion are formed on an outer surface on a front side of the housing and an outer surface of the slider, respectively.

DESCRIPTION OF THE PREFERRED EMBODIMENTS

Figure 1:
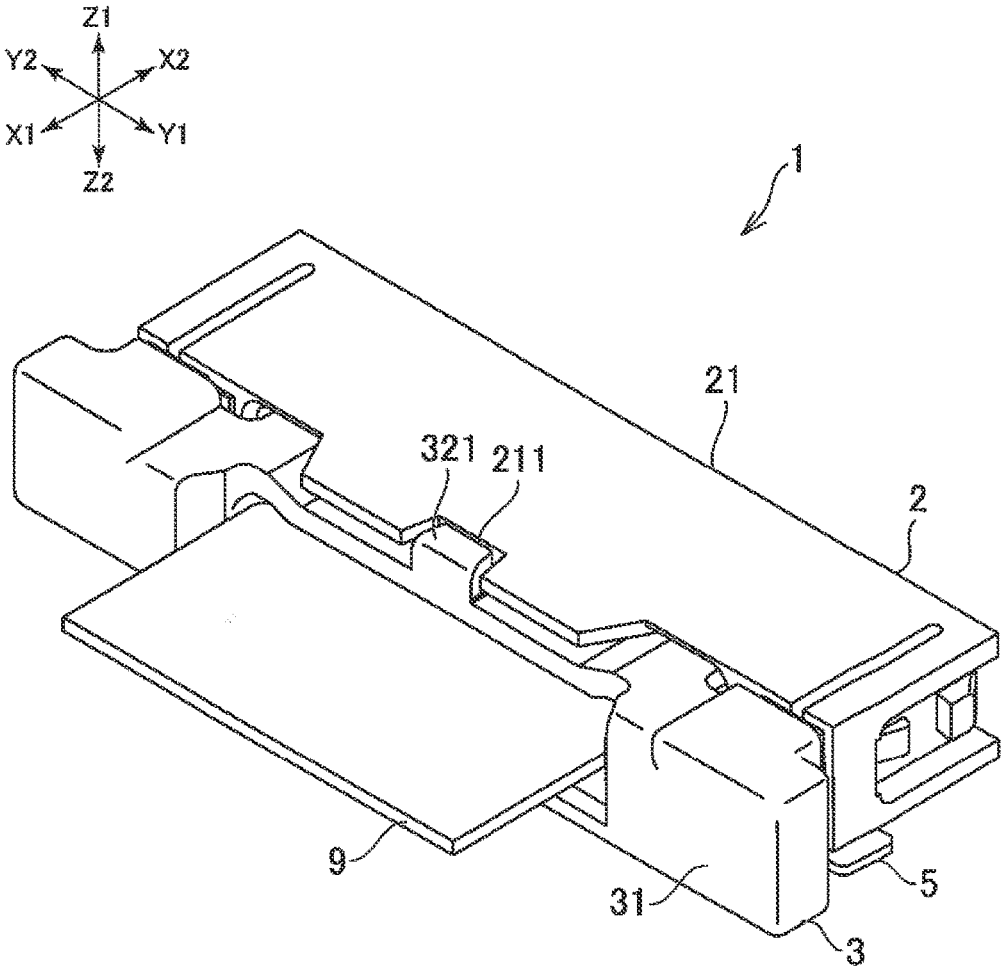
FIG. 1 is a perspective view illustrating a connector 1 and a flat cable 9 according to the present disclosure.
Figure 2:
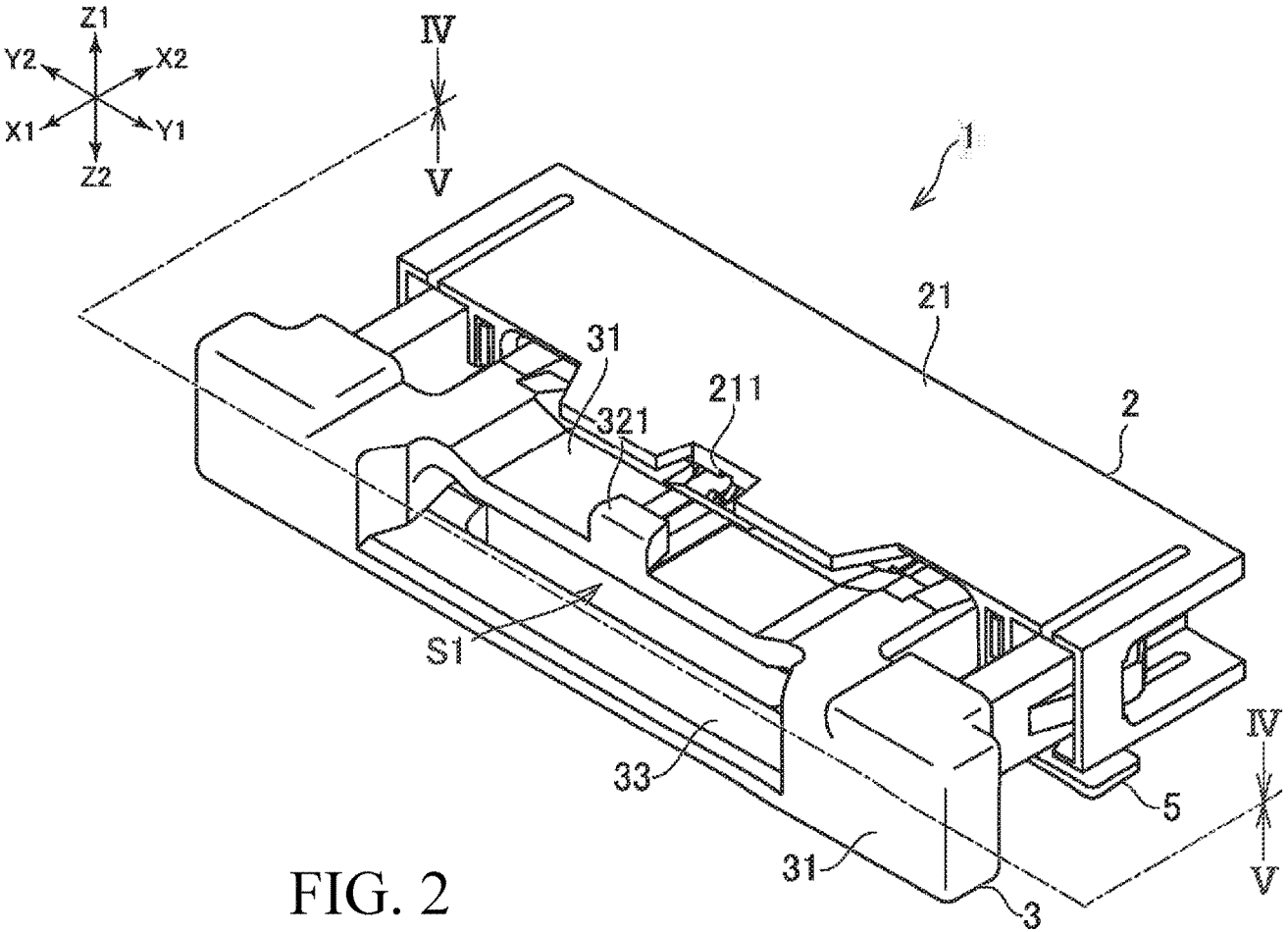
FIG. 2 is a perspective view of the connector 1.
Figure 3:
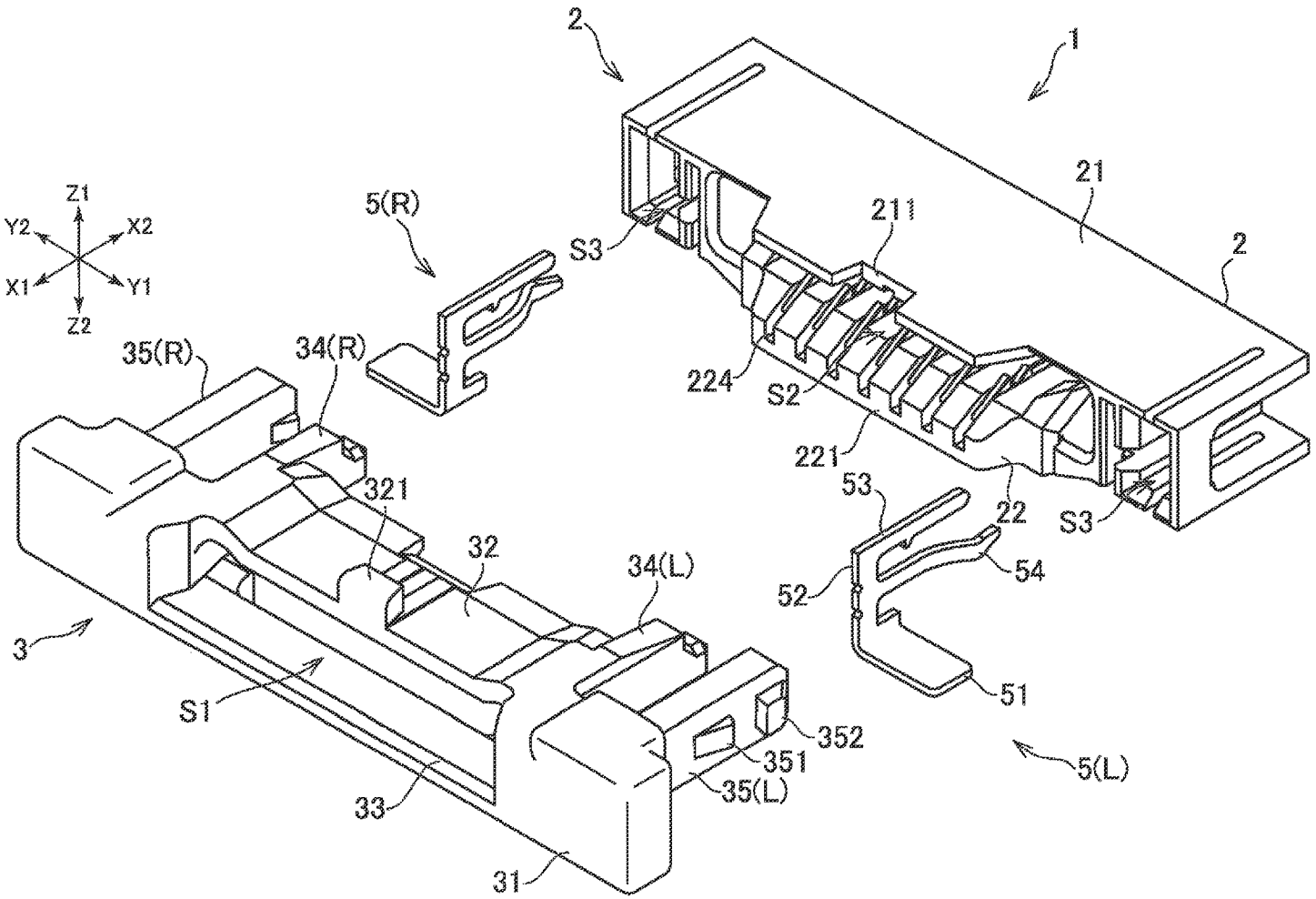
FIG. 3 is an exploded view of the connector 1.
Figure 4:
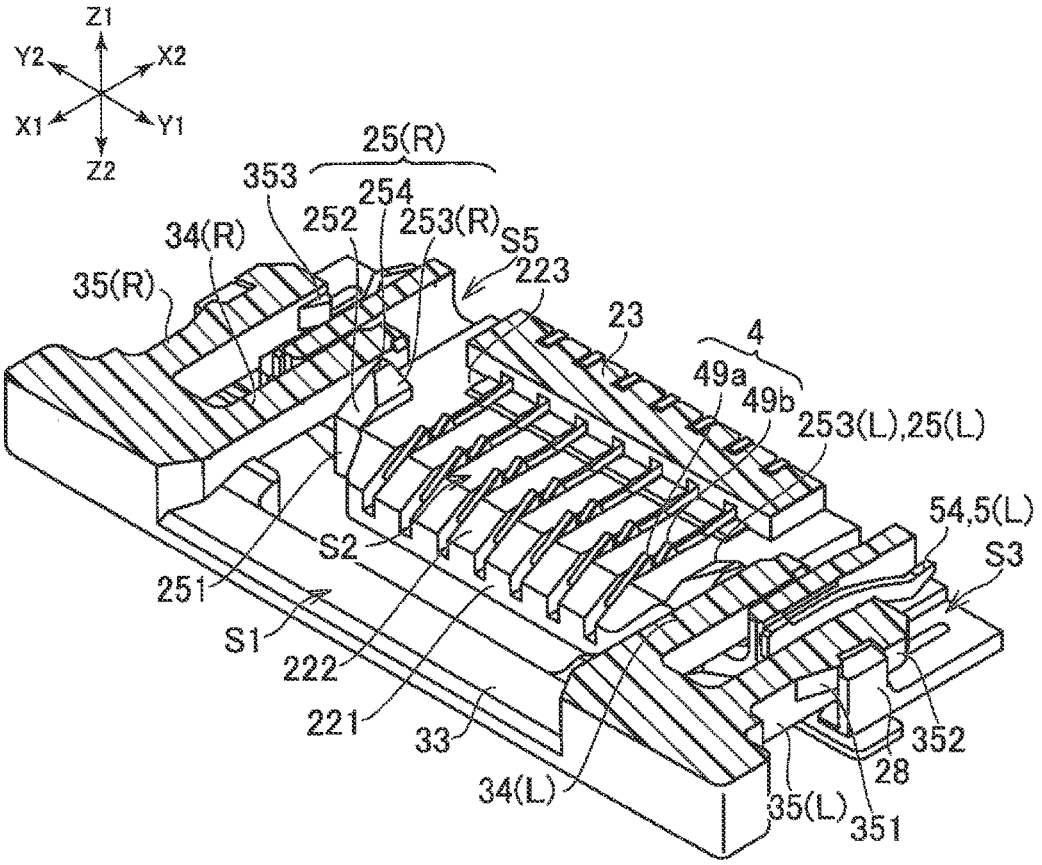
FIG. 4 is a view illustrating a cross section along line IV-IV in FIG. 2.
Figure 5:
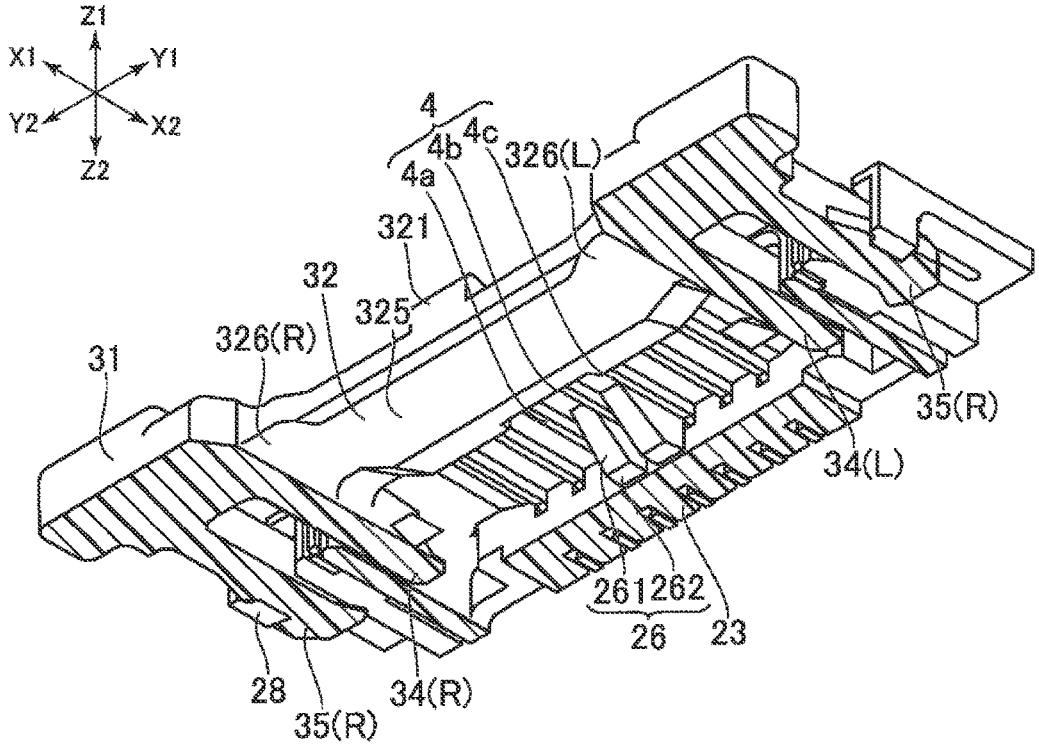
FIG. 5 is a view illustrating a cross section along line V-V in FIG. 2.
Figure 6:
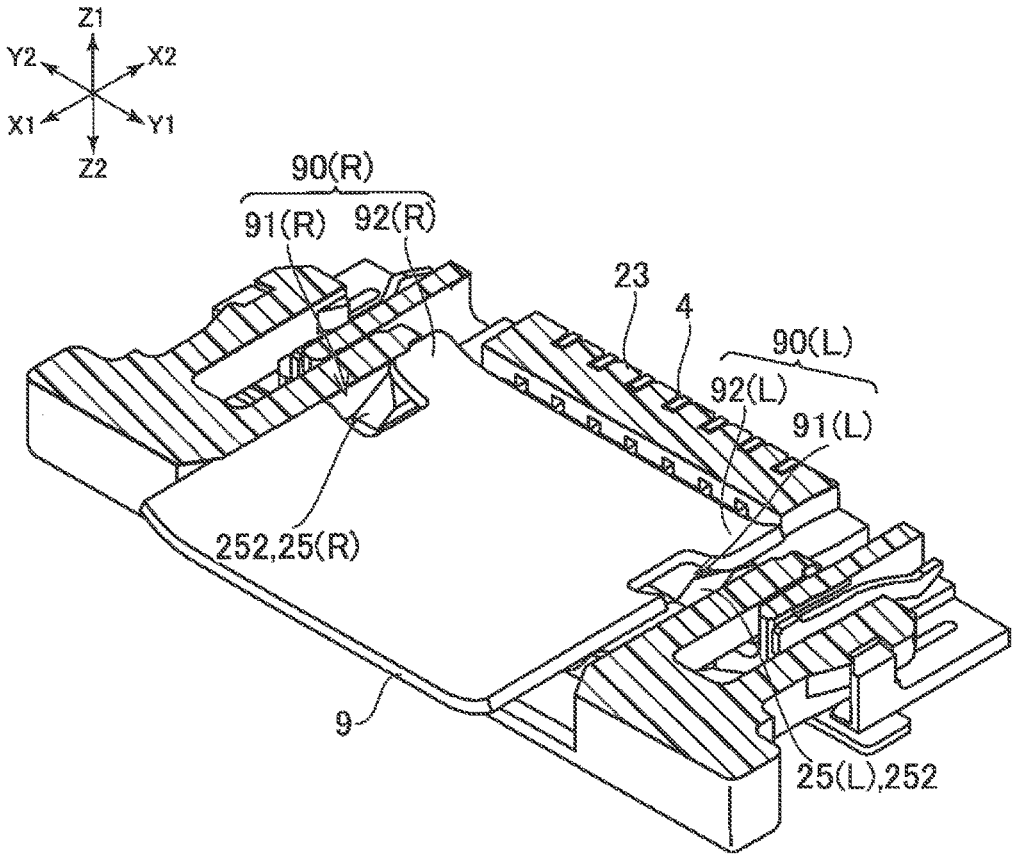
FIG. 6 is a cross sectional view illustrating the flat cable 9 while inserted.
Figure 7:
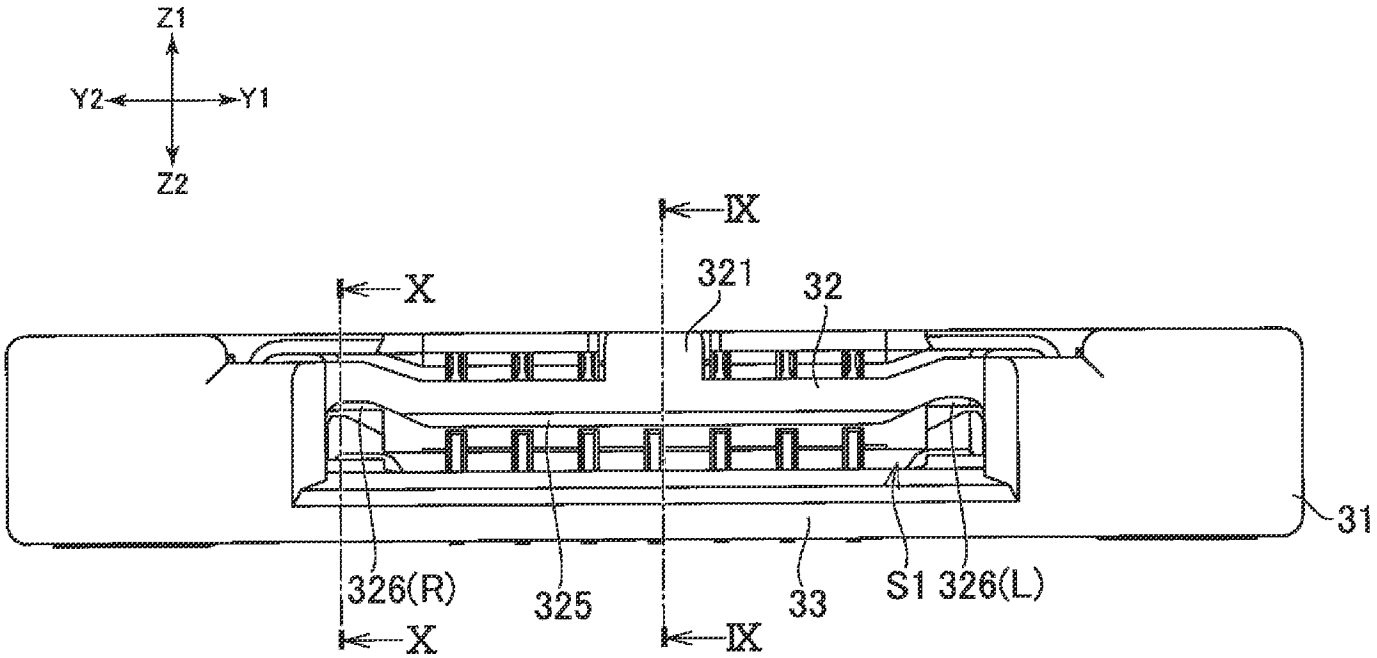
FIG. 7 is an elevation view of the connector 1.
Figure 8:
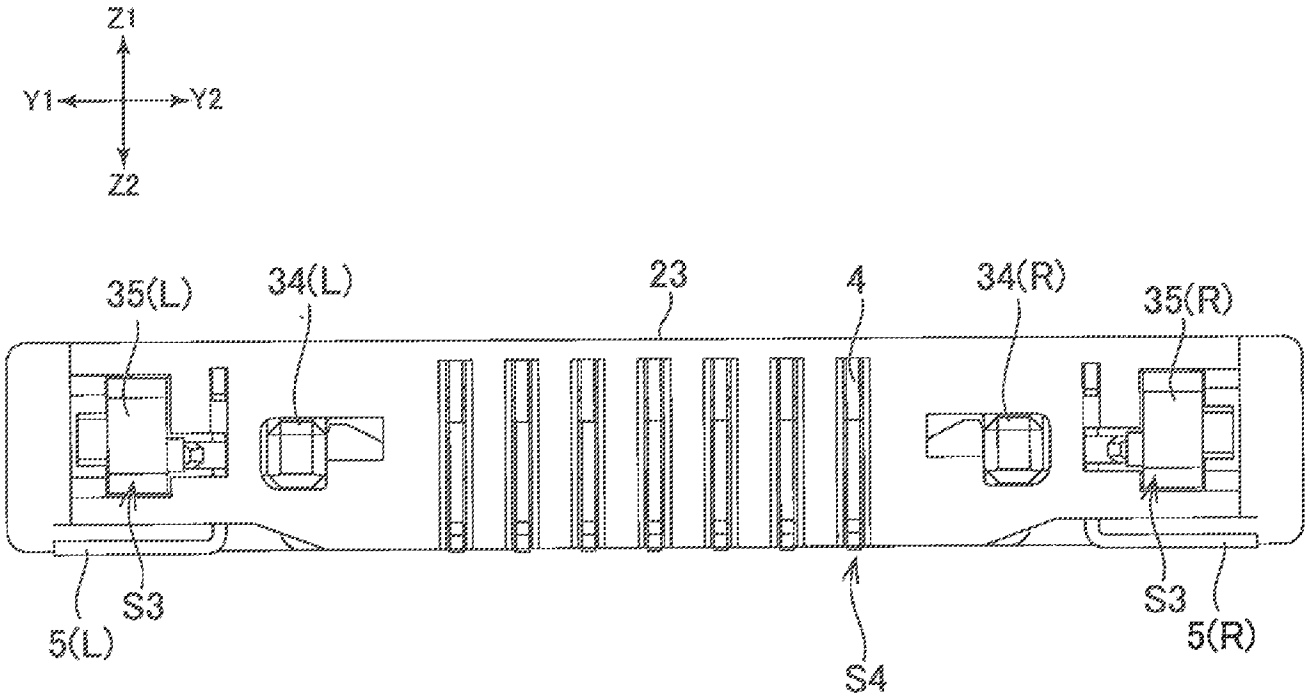
FIG. 8 is a rear view of the connector 1.
Figure 9:
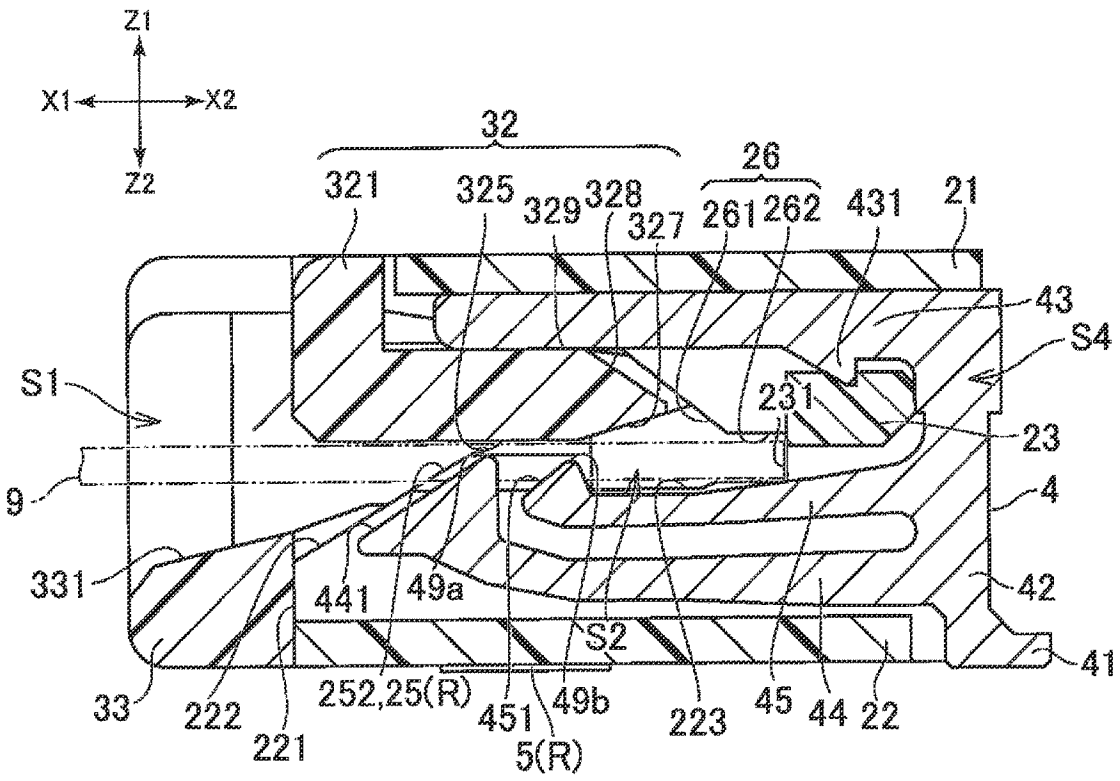
FIG. 9 is a view illustrating a cross section along line IX-IX in FIG. 7.
Figure 10:
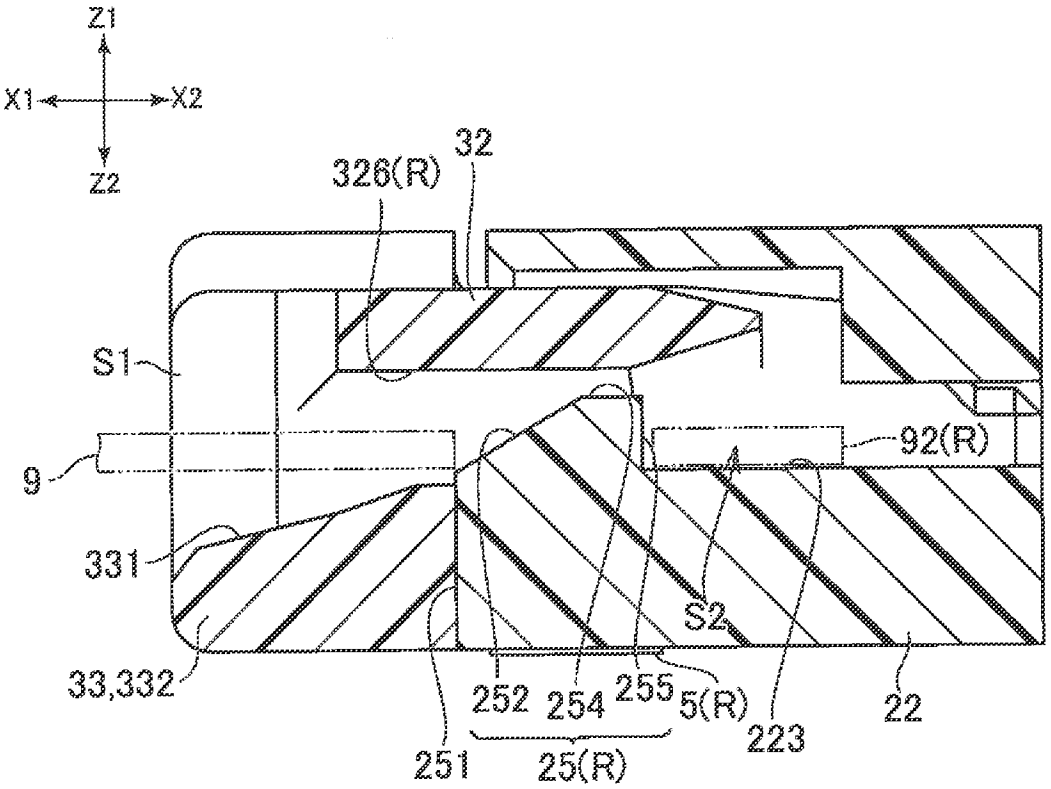
FIG. 10 is a view illustrating a cross section along line X-X in FIG. 7.
Figure 11:
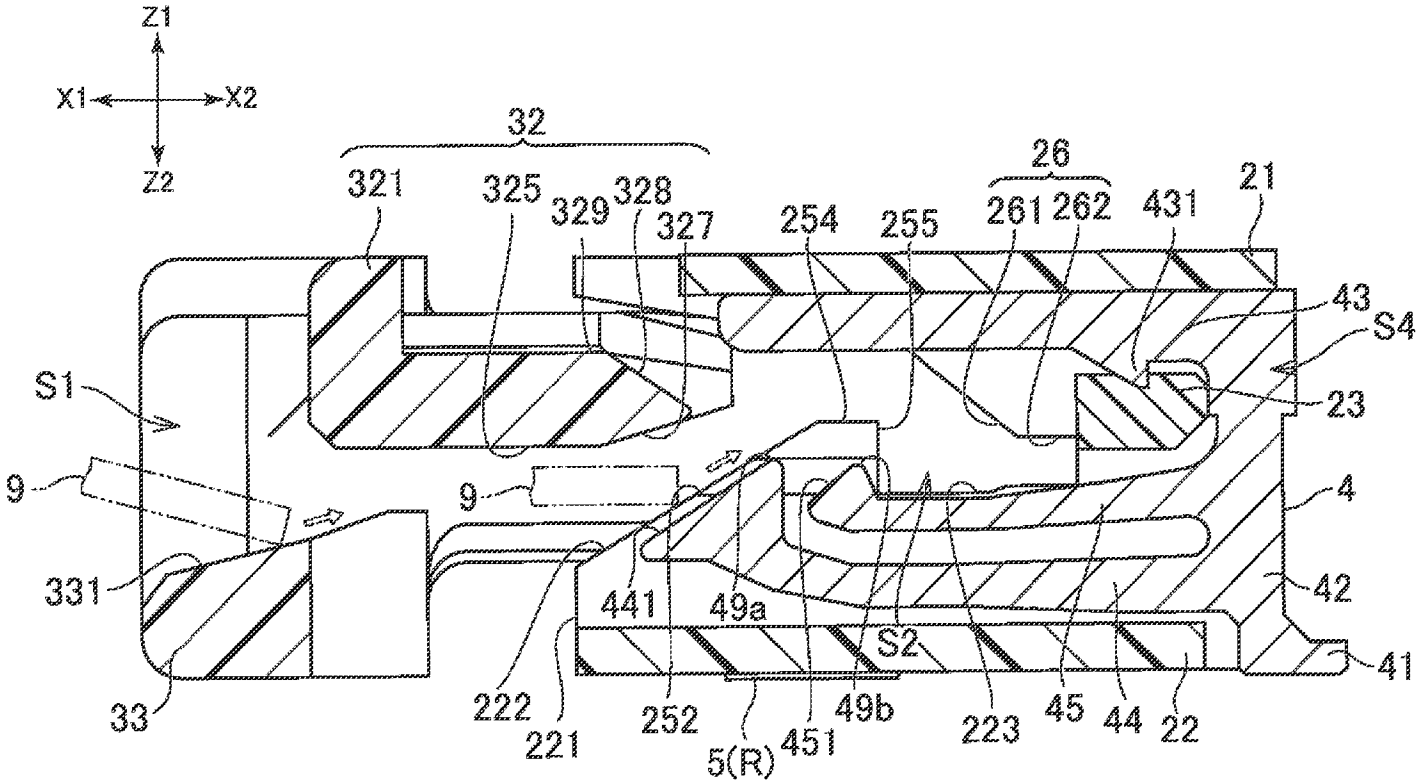
FIG. 11 is a view illustrating a cross section of the connector 1.

The connector 1 according to the present embodiment is described below with reference to FIG. 1 through FIG. 11. FIG. 1 is a perspective view illustrating the connector 1 and the flat cable 9 according to the present embodiment. FIG. 2 is a perspective view illustrating a case where the connector 1 and a slider 3 are slid to a front side. FIG. 3 is an exploded view of the connector 1. FIG. 4 is a view illustrating a cross section along line IV-IV in FIG. 2, and, in particular, a view illustrating a lower side of the connector 1. FIG. 5 is a view illustrating a cross section along line V-V in FIG. 2, and, in particular, a view illustrating an upper side of the connector 1. FIG. 6 is a view illustrating the flat cable 9 inserted in the connector 1. FIG. 7 is an elevation view of the connector 1. FIG. 8 is a rear view of the connector 1. FIG. 9 is a view illustrating a cross section along line IX-IX in FIG. 7, and a view illustrating a center cross section in a left to right direction of the connector 1. FIG. 10 is a view illustrating a cross section along line X-X in FIG. 7, and, in particular, a view illustrating a cross section from the right of the connector 1. FIG. 11 is a view illustrating a cross section of the connector 1 in the position illustrated in FIG. 9, and a view illustrating a case where a slider 3 has been slid forward. Furthermore, FIG. 11 illustrates a case where the flat cable 9 is inserted inside a housing 2, and a case where the cable is inserted inside a hole S1 formed in the slider 3.

In all of the drawings, the insertion direction (direction illustrated by X1) of the flat cable 9 inserted into the connector 1 is frontward, and the direction opposite (direction illustrated by X2) the insertion direction is rearward. Furthermore, the directions illustrating a width of the flat cable 9 (directions illustrated by Y1 and Y2) are the left direction and the right direction, respectively. Furthermore, the directions illustrating a thickness of the flat cable 9 (directions illustrated by Z1 and Z2) are upward and downward, respectively. Note that directions are only used to describe the relative positional relationships of the parts that configure the connector 1, and thus do not illustrate absolute directions.

The connector 1 according to the present embodiment is a connector that enables the insertion of a flat cable 9 along an extending direction thereof. As illustrated in FIG. 1, the connector 1 is formed into a substantially rectangular cylindrical shape, and the flat cable 9 is inserted inside thereof. The flat cable 9 may be, for example, a Flexible Printed Circuit (FPC) or a Flexible Flat Cable (FFC).

As illustrated in FIG. 1 and FIG. 2, the connector 1 has a housing 2 and a slider 3 positioned on a front side of the housing 2. The housing 2 and the slider 3 may be formed using a material having insulating properties, such as resin, and the like.

As illustrated in FIG. 3, the housing 2 has a space S2 open in a front surface of the housing 2. The flat cable 9 is inserted from a front side to a rear side in the space S2 of the housing 2. Furthermore, the space S2 is formed wider in a left to right direction than the flat cable 9. The space S2 is formed in a center in a left to right direction of the housing 2.

As illustrated in FIG. 3, FIG. 8, FIG. 9, and FIG. 11, the housing 2 has an upper wall 21 configuring an upper surface of the housing 2, a low wall 22 configuring a bottom surface thereof, and a rear wall 23 configuring a rear surface thereof. Here, a space between the upper wall 21 and the lower wall 22 is the space S2 into which the flat cable 9 is inserted.

As illustrated in FIG. 4, FIG. 9, and FIG. 11, a slanted surface 222 extending obliquely rearward and upward is formed on a lower side edge of the space S2 of the housing 2. The slanted surface 222 is formed on a front side of the housing 2. For example, the slanted surface 222 is formed on a front surface 221 of the lower wall 22, and is connected to an upper surface 223. As illustrated in FIG. 11, a tip of the flat cable 9 abuts the slanted surface 222 formed in the housing 2, and is thus guided toward an inside of the space S2.

As illustrated in FIG. 4, the housing 2 holds a plurality of terminals 4. The terminals 4 are formed using a conductive material, such as a metal. Furthermore, the terminals 4 are inserted aligned along a left to right direction in the space S2 of the housing 2. A groove 224 is formed in the lower wall 22 of the housing 2, and the terminals 4 are arranged on an inside of the groove 224.

As illustrated in FIG. 9 and FIG. 11, the terminal 4 that is inserted in the space S2 of the housing 2 has a connecting portion 41 that is positioned on a rear and lower end of the housing 2 and connects to a circuit board not illustrated in the figures, a strut portion 42 that extends upward from the connecting portion 41, an upper arm 43 that extends frontward from an upper side of the strut portion 42, a first lower arm 44 that is positioned farther downward than the upper arm 43 and extends frontward from the strut portion 42, and a second lower arm 45 that is positioned between the upper arm 43 and the first lower arm 44 and extends frontward from the strut portion 42. The first and second lower arms 44 and 45 are formed so as to be able to bend elastically downward. Furthermore, a space between the upper arm 43 and the first and second lower arms 44 and 45 of the terminal 4 may be the space S2 into which the flat cable 9 is inserted. A tab portion 431 that catches in the rear wall 23 of the housing 2 is formed in a space between a front end and a rear end of the arm 43.

Furthermore, a first slanted surface 441 extending obliquely rearward and upward is formed on a front end of the first lower arm 44 of the terminal 4, and a second slanted surface 451 extending obliquely rearward and upward and positioned rearward of the first slanted surface 441 is formed on a front end of the second lower arm 45. Contacts 49*a* and 49*b* that make contact with a lower side of the flat cable 9 are provided on an upper end of the first slanted surface 441 and an upper end of the second slanted surface 451, respectively. The contact 49*b* is provided farther rearward than the contact 49*a*, and the contacts 49*a* and 49*b* are arranged farther rearward than the slanted surface 222 formed in the lower wall 22 of the housing 2. Furthermore, the contacts 49*a* and 49*b* are arranged in the same positions in a vertical direction, and are arranged farther upward (for example, on an outside of the groove 224 formed on the lower wall 22) than the upper surface 223 of the lower wall 22.

As illustrated in FIG. 8, a plurality of holes S4 are formed aligned in a left to right direction in the rear wall 23 of the housing 2. The holes S4 are connected to the space S2, and the plurality of terminals 4 are inserted into the plurality of holes S4 aligned facing from a rear side to a front side.

As illustrated in FIG. 4, FIG. 10, and FIG. 11, two locking convex portions 25(L) and 25(R), which are protrusions for locking the flat cable 9, are formed on a lower side of the space S2 of the housing 2. The locking convex portions 25(L) and 25(R) are formed in the upper surface 223 of the lower wall 22 of the housing 2. The locking convex portions 25(L) and 25(R) are formed so as to protrude toward an upper side of the space 2 from a lower side thereof. The locking convex portion 25(L) is positioned on a left side with respect to the plurality of terminals 4 aligned left to right, and the locking convex portion 25(R) is positioned on a right side with respect to the plurality of terminals 4.

Furthermore, as illustrated in FIG. 6, engaging portions 90(L) and 90(R) having either a notch, a cavity, or a hole, are formed to the left and right of the flat cable 9. The engaging portion 90(L) is formed on a left side of the flat cable 9, and the engaging portion 90(R) is formed on a right side of the flat cable 9. The following description assumes that the engaging portion 90(L) formed on the left side has a notch 91(L) and an edge portion 92(L) on a front side of the notch, and that the engaging portion 90(R) formed on the right side has a notch 91(R) and an edge portion 92(R) on a front side of the notch.

The engaging portions 90(L) and 90(R) formed on the left side and the right side of the flat cable 9 catch in the left and right locking convex portions 25(L) and 25(R). For example, the left and right locking convex portions 25(L) and 25(R) fit into the left and right notches 91(L) and 91(R) of the flat cable 9 illustrated in FIG. 6, and may be made to catch in the front side edges 92(L) and 92(R). Note that in the following description, the left and right locking convex portions 25(L) and 25(R) are referred to simply as the convex portion 25. Furthermore, the left and right engaging portions 90(L) and 90(R) are referred to simply as the engaging portion 90, the left and right notches 91(L) and 91(R) are referred to simply as the notch 91, and the edge portions 92(L) and 92(R) on the front sides of the notches 91(L) and 91(R) are referred to simply as the edge portion 92.

Furthermore, as illustrated in FIG. 4, a slanted surface 252 extending obliquely rearward and upward is formed on a front surface 251 of the locking convex portion 25. Furthermore, as illustrated in FIG. 4, a slanted surface 253(L) extending obliquely upward and to the left is formed on a right side surface of the left side locking convex portion 25(L), and a slanted surface 253(R) extending obliquely upward and to the right is formed on a left side surface of the right side locking convex portion 25(R). Furthermore, in the cross-sectional view illustrated in FIG. 11, the slanted surface 252 of the locking convex portion 25 is positioned on an extension line of the slanted surface 222 formed in the lower wall 22 of the housing 2. That is, the slanted surface 222 of the lower wall 22 and the slanted surface 252 of the locking convex portion 25 are formed on the same plane. Furthermore, a rear surface 255 of the locking convex portion 25 extends in a direction that is substantially perpendicular with respect to the upper surface 223 of the lower wall 22 of the housing 2. Furthermore, a top portion 254 of the locking convex portion 25 is formed farther upward than the contacts 49*a* and 49*b* of the terminal 4.

As illustrated in FIG. 6, in a process for inserting the flat cable 9 on the inside of the space S2, the edge portion 92(L) on the front side of the notch 91(L) on the left side and the edge portion 92(R) on the front side of the notch 91(R) on the right side ride up on the locking convex portions 25(L) and 25(R) formed on the right side and the left side in the space S2 of the housing 2. As was described above, the slanted surface 252 extending obliquely upward and rearward is formed in the front surface 251 of the locking convex portion 25. Therefore, the front end of the flat cable 9 advances along the slanted surface 252, and the edge portion 92 of the flat cable 9 is made to easily ride up on the locking convex portion 25. Furthermore, the slanted surface 252 of the locking convex portion 25 is formed on the same plane as the slanted surface 222 of the lower wall 22. Therefore, a front end including the edge portion 92 of the flat cable 9 is able to advance smoothly from the front surface of the housing 2 toward the locking convex portion 25. Additionally, the top portion 254 of the locking convex portion 25 is formed farther upward than the contacts 49*a* and 49*b* of the terminal 4. Therefore, the edge portion 92 of the flat cable 9 is able ride up on the locking convex portion 25 while contact between the flat cable 9 and the contacts 49*a* and 49*b* is prevented.

As illustrated in FIG. 5, FIG. 9, and FIG. 11, a first guide portion 26, which is a part for guiding the flat cable 9 toward the lower side of the space S2 is formed in the upper side of the space S2 of the housing 2. The first guide portion 26 is formed on the upper wall 21 of the housing 2. The first guide portion is formed so as to protrude from the upper side toward the lower side of the space S2. Furthermore, the first guide portion 26 is arranged between the left side locking convex portion 25(L) and the right side locking convex portion 25(R). In other words, the first guide portion 26 is provided in a position farther to the center of the housing 2 in the left to right direction than the two convex portions 25(L) and 25(R). Furthermore, the first guide portion 26 is formed between, of the plurality of terminals 4 aligned in the left to right direction, the terminal 4 on a left end and the terminal 4 on a right end. The first guide portion 26 is formed between two adjacent terminals 4. In the example illustrated in FIG. 5, the first guide portion 26 is formed between adjacent terminals 4*a* and 4*b* and between terminals 4*b* and 4*c* near the center of the housing 2.

As illustrated in FIG. 11, the first guide portion 26 is positioned farther rearward than the two locking convex portions 25. For example, the locking convex portion 25 is formed near a front edge of the space S2, and the first guide portion 26 is formed near a rear edge of the space S2. The first guide portion 26 is formed farther rearward than the contacts 49*a* and 49*b* of the terminal 4, and is connected to a front surface 231 of the rear wall 23. Furthermore, a slanted surface 261 extending obliquely rearward and downward is formed on the first guide portion 26. The slanted surface 261 is connected to the upper wall 21 of the housing 2 and to a lower edge 262 of the first guide portion 26.

The flat cable 9, which is raised up by riding up on the locking convex portions 25(L) and 25(R), in a position between the two locking convex portions 25(L) and 25(R) in the left and right direction thereof, abuts the slanted surface 261 of the first guide portion 26, and is thus guided along the slanted surface 261 extending obliquely rearward and downward. Therefore, the flat cable 9 is arranged on a lower side of the first guide portion 26. Additionally, because the flat cable 9 is guided downward by the first guide portion 26 in this way, the flat cable 9 is elastically deformed in a state where the left and right ends thereof are lifted up on an upward side. Here, as illustrated in FIG. 4, slanted surfaces 253(L) and 253(R) extending obliquely upward left and right are formed on inner surfaces of the left and right locking convex portions 25(L) and 25(R). By forming a slanted surface 25S on the side surface of the locking convex portion 25 in this way, contact between the flat cable 9 and sharp places on the inside of the housing 2 is avoided, which makes it possible to prevent scratching of the flat cable 9 when the flat cable 9 moves frontward and backward.

Furthermore, by pushing the flat cable 9 further rearward from a state where the flat cable 9 is riding up on the locking convex portion 25, the locking convex portion 25 of the housing 2 fits into the notch 91 of the flat cable 9, and the engaging portion 90 of the flat cable 9 catches in the locking convex portion 25. Here, by returning the flat cable 9 from a state of being elastically deformed to an original state, the cable will hit an edge (for example, the lower wall 22) of the space S2 of the housing 2. Because a noise is created at this time, a worker can easily recognize that the engaging portion 90 of the flat cable 9 has caught on the locking convex portion 25, and that the flat cable 9 and the connector 1 are thus fitted together.

Note that while the example illustrated in FIG. 5 describes a case where the first guide portion 26 is formed between two adjacent terminals 4 near the center of the housing 2, the guide portion is not limited to this, and that the first guide portion 26 may thus be formed between the two locking convex portions 25(L) and 25(R). For example, the first guide portion 26 may be formed in a position closer to one or both of the left and right locking convex portions 25 than illustrated in FIG. 5. In this manner, the raising angle at which the edge portion 92 of the flat cable 9 raises becomes steeper than that illustrated in FIG. 6, which increases the noise caused when the engaging portion 90 of the flat cable 9 catches in the locking convex portion 25. That is, it becomes even easier for a worker to recognize that the flat cable 9 and the connector 1 are fitted together.

As illustrated in FIG. 10, the edge portion 92 of the flat cable 9 is inserted farther rearward than the rear surface 255 of the locking convex portion 25. Here, the flat cable 9 can be prevented from being pulled out because the edge portion 92 of the flat cable 9 catches on the rear surface 255 of the locking convex portion 25 when the flat cable 9 is pulled frontward.

Furthermore, as illustrated in FIG. 9, the flat cable 9 is inserted inside the space S2 of the housing 2 to a position where the front end of the flat cable 9 hits the front surface 231 of the rear wall 23. When the flat cable 9 is inserted inside the space S2, the front end of the flat cable 9 is positioned between the lower wall 22 of the housing 2 and the lower edge 262 of the first guide portion 26 in a vertical direction. The vertical movement of the flat cable 9 can be regulated and the engaging portion 90 of the flat cable 9 can be prevented from being separated from the locking convex portion 25 because the front end of the flat cable 9 is positioned in the lower side of the first guide portion 26.

Note that a concavity or a hole may be formed in the engaging portion 90 of the flat cable 9 in place of forming the notch 91 illustrated in FIG. 6. In this case, after the front edge of the concavity or the hole of the flat cable 9 rides up on the locking convex portion 25, the locking convex portion 25 fits inside the concavity of the hole of the flat cable 9.

Furthermore, the locking convex portion 25 and the first guide portion 26 arranged inside the space S2 of the housing 2 may be formed integrally with the housing 2 using, for example, a resin material. This makes it possible to scratch the flat cable 9 less than in a case where at least one of the locking convex portion 25 or the first guide portion 26 is formed using a metal material.

As was described above, the connector 1 has the slider 3 positioned on the front side of the housing 2. As illustrated in FIG. 1 and FIG. 2, the slider 3 is moved forward in a state of being fitted with the housing 2. More specifically, the slider 3 is made such that the slider 3 is able to slide between a first position (see FIG. 1) fitted with the housing 2 and a second position (see FIG. 2) separated farther forward than the first position. Here, the slider 3, when in the first position, presses the flat cable 9 in the direction of where the contacts 49*a* and 49*b* of the terminal 4 are positioned, and releases the pressing with respect to the flat cable 9 when in the second position.

Furthermore, as illustrated in FIG. 2 and FIG. 3, a hole S1, through which the flat cable 9 is pressed, is formed in the slider 3. The hole S1 in slider 3 is arranged farther forward than the space S2 formed in the housing 2. The hole S1 is formed in the center of the slider 3 in the left to right direction, and the slider 3 passes therethrough along a front to rear direction. The flat cable 9 is inserted inside the hole S1 from the front side of the slider 3, and then the flat cable 9 can be housed in the space S2 of the housing 2.

As illustrated in FIG. 2, a front surface 31 of the slider 3 is formed wider in the left to right direction than the housing 2. Forming the front surface 31 of the slider 3 wide in this way increases a contact surface between the slider 3 and a finger of a worker, making the slider 3 easy to operate.

As illustrated in FIG. 2, FIG. 3, and FIG. 11, the slider 3 has a pressing portion 32 and a second guide portion 33 extending in the front to rear direction. Here, the pressing portion 32 configures an upper side of the hole S1. Furthermore, the second guide portion 33 is positioned farther downward than the pressing portion 32, and thus configures an edge of a lower side of the hole S1.

As illustrated in FIG. 11, a slanted surface 331 extending obliquely upward and rearward is formed on an upper surface of the second guide portion 33 formed on the lower side of the slider 3. Because the front end of the flat cable 9 abuts the slanted surface 331 of the second guide portion 33, the cable is guided toward the inside of the hole S1. That is, the flat cable 9 is guided toward a direction where the space S2 of the housing 2 is positioned.

As illustrated in FIG. 2 and FIG. 11, an edge on the upper side of the hole S1 formed in the slider 3 is positioned farther rearward than a downward edge. That is, the second guide portion 33 is positioned farther forward than the pressing portion 32. This allows an operator to observe the second guide portion 33 from above the connector 1, which makes it possible to insert the flat cable 9 with the second guide portion 33 in full view. Because the front end of the flat cable 9 inserted obliquely from in front and above the connector 1 hits the slanted surface 331 of the second guide portion 33, a direction of advance thereof is corrected so as to be guided inside the hole S1.

As illustrated in FIG. 9, in addition to the flat cable 9, the slider 3 is inserted is also inserted in the space S2 of the housing 2. The pressing portion 32 of the slider 3 is inserted below the upper wall 21 of the housing 2, and above the flat cable 9 inserted into the space S2. The pressing portion 32 is inserted between, for example, the upper arm 43 and the first and second lower arms 44 and 45 of the terminal 4.

Furthermore, a pressing surface 325 that abuts the flat cable 9 and presses the flat cable 9 downward is formed in the pressing portion 32 of the slider 3. As illustrated in FIG. 9, the pressing surface 325 covers the two contacts 49*a* and 49*b* formed in the terminal from above when the slider 3 is arranged in the first position fitted with the housing 2. Here a distance between the contact 49*a* and the pressing surface 325 and a distance between the contact 49*b* and the pressing surface 325 are made narrower than the thickness of the flat cable 9. Therefore, inserting the pressing portion 32 of the slider 3 presses the flat cable 9 and the contacts 49*a* and 49*b* downward. Furthermore, a force acts upon the first and second lower arms 44 and 45 in which the contacts 49*a* and 49*b* are provided such that said arms recover from shapes where they are elastically bent downward to their original shapes. That is, a contact pressure between the lower side of the flat cable 9 and the contacts 49*a* and 49*b* is sustained, and thus the cable and the contacts can be brought into actual contact.

As illustrated in FIG. 7, the hole S1, through which the slider 3 passes in a front and rear direction, is put in a state where the left and right edges of said hole are raised up. Here, in addition to the pressing surface 325, two adjacent surfaces 326(L) and 326(R), positioned on a left side and a right side, respectively, of the pressing surface 325 and farther upward than the pressing surface 325, are also formed in the pressing portion 32 of the slider 3. Furthermore, as illustrated in FIG. 10, the two adjacent surfaces 326(L), 326(R) can extend horizontally along the front and back direction, and extend to the opening of the hole S1. Furthermore, when the slider 3 is arranged in the first position, the adjacent surfaces 326(L) and 326(R) cover the locking convex portions 25(L) and 25(R) formed to the left and right of the housing 2. The adjacent surface 326 is arranged in a position separated upward from the top portion 254 of the locking convex portion 25.

By moving the slider 3 into the second position and thus bending the flat cable 9 into a shape where the left and right ends of the flat cable 9 are raised upward, a worker can raise the engaging portion 90 (for example, the edge portion 92 illustrated in FIG. 6) of the flat cable 9, separate the locking convex portion 25 of the housing 2 from the engaging portion 90, and then pull the flat cable 9 from the connector 1. Here, because the adjacent surface 326 is arranged in a position separated upward from the top portion 254 of the locking convex portion 25, a worker can bend the flat cable 9 into a shape where the left and right ends of the flat cable 9 are raised comparatively easily.

Furthermore, as illustrated in FIG. 11, a slanted surface 327, connected to the pressing surface 325 on the lower side and extending obliquely rearward and upward, is formed on a rear side of the pressing portion 32 of the slider 3. When the pressing portion 32 of the slider 3 is positioned farther forward than the space S2 of the housing 2 (for example, when the slider 3 is in the second position), the flat cable 9 is inserted into the space S2 passing between the slanted surface 222 formed in the lower wall 22 of the housing 2 and the slanted surface 327 of the slider 3 and between the slanted surface 252 formed in the locking convex portion 25 and the slanted surface 327 of the slider 3. Because the slanted surface 327 is formed on a rear surface of the pressing portion 32 in this way, it is possible to keep the front end of the flat cable 9 advancing obliquely upward along the slanted surfaces 222 and 252 of the housing 2 from hitting the rear surface of the pressing portion 32.

Furthermore, as illustrated in FIG. 9, a slanted surface 328, connected to an upper surface 329 of the slider 3 and extending obliquely rearward and downward, is formed on a rear surface of the pressing portion 32 of the slider 3. When the slider 3 is in the first position fitted with the housing 2 and the pressing portion 32 is thus inserted into the space S2 of the housing 2, the slanted surface 328 of the slider 3 is arranged below slanted surface 261 of the first guide portion 26 formed in the housing 2. Because the pressing portion 32 of the slider 3 is added to the front side of the space S2 formed in the housing 2 and also enters below the first guide portion 26 formed in the rear side of the space S2, the connector 1 can be miniaturized in the front and rear direction.

As illustrated in FIG. 1 through FIG. 3, an outer concave portion 211 having a cavity is formed on an outer surface of the front side of the housing 2. Furthermore, an outer convex portion 321 that fits in the cavity of the outer concave portion 211 is formed in an outer surface of the slider 3. The outer convex portion 321 protrudes toward an outer side from an edge of the hole S1 formed in the front surface 31 of the slider 3. For example, the outer concave portion 211 is formed in a front surface of the upper wall 21, and the outer convex portion 321 is formed so as to protrude toward an upper side from a front end of the pressing portion 32. Note that the outer concave portion 211 and the outer convex portion 321 are formed positioned in the center of the connector 1 in the left to right direction, where the outer concave portion 211 is formed between portions protruding on a front side positioned in the center of the upper wall 21 in the left to right direction.

As illustrated in FIG. 1, when the slider 3 is in the first position fitted with the housing 2, the outer convex portion 321 fits in the inside of the outer concave portion 211. Therefore, a worker can easily and intuitively see that, in the first position, the slider 3 is fitted in the housing 2. Furthermore, the outer convex portion 321 extends upward so as to reach the upper surface of the housing 2. Therefore, a worker can easily and intuitively see that the flat cable 9 cannot be inserted in a gap generated between the slider 3 and the housing 2 in the vertical direction.

As illustrated in FIG. 4, a front surface 221 formed between the left and right locking convex portions 25 protrudes toward a front side with respect to the front surface 251 of the locking convex portion 25 in the lower wall 22 of the housing 2. Furthermore, the second guide portion 33 formed in the slider 3 is concave so as to correspond to a shape where the lower wall 22 of the housing 2 protrudes toward the front side.

As illustrated in FIG. 3, the slider 3 has, in addition to the pressing portion 32 and the second guide portion 33 described above, two extended portions 34(L) and 34(R) extending in a rearward direction from a rear side of the front surface 31. The extended portion 34(L) formed on the left side of the slider 3 configures an edge on the right side of the hole S1, and the extended portion 34(R) formed on the right side of the slider 3 configures an edge on the right side of the hole S1. The left and right extended portions 34(L) and 34(R) are connected to the pressing portion 32 by an upper end and to the second guide portion 33 by a lower end.

As illustrated in FIG. 4, in addition to the flat cable 9 and the pressing portion 32 of the slider 3, the two extended portions 34(L) and 34(R) are also inserted into the space S2 of the housing 2. The left side extended portion 34(L) is inserted on a left side of the left side locking convex portion 25(L), and the right side extended portion 34(R) is inserted on a right side of the right side locking convex portion 25(R), respectively. Because the extended portions 34(L) and 34(R) of the slider 3 are inserted into the space S2 of the housing 2 in this way, it is possible to suppress any vertical direction and left to right direction rattling of the slider 3.

As illustrated in FIG. 3, the slider 3 has two arms 35(L) and 35(R) extending rearward from the rear side of the front surface 31 of the slider 3. The arm 35(L) is formed on a left side of the left side extended portion 34(L), and the arm 35(R) is formed on a right side of the right side extended portion 34(R). The left and right arms 35(L) and 35(R) are formed so as to be symmetrical in the left to right direction.

Furthermore, as illustrated in FIG. 4, two holes S3 for housing the left and right arms 35(L) and 35(R) of the slider 3 are formed on a right side and a left side with respect to the space S2 of the housing 2. The holes S3 penetrate through the housing 2 in the front to rear direction. Furthermore, a gap through which a retainer 5 can be inserted is formed between the space S2 and the hole S3 of the housing 2.

As illustrated in FIG. 3, the retainer 5 has a connecting portion 51 that connects to a circuit board not illustrated in the figure, a strut portion 52 extending upward from an edge of the connecting portion 51, an arm 53 that extends rearward from an upper side of the strut portion 52 and has a tab-shaped portion that catches in the housing 2, and a spring portion 54 that extends in the front and rear direction on a lower side of the arm 53 and bends to the left and to the right. A left side retainer 5(L) inserted in the left side hole S3 and a right side retainer 5(R) inserted in the right side hole S3 are formed so as to be symmetrical in the left to right direction.

As illustrated in FIG. 4, two convex portions 351 and 352 placed aligned with a distance therebetween in the front and rear direction are formed on a left side surface of the left side arm 35(L) and on a right side surface of the right side arm 35(R) of the slider 3, and a side wall portion 28 extending in the vertical direction of the housing 2 fits in a cavity between these two convex portions. Therefore, it is possible to prevent the slider 3 from being pulled out or removed when the slider 3 is arranged in the second position (see FIG. 2). Furthermore, a convex portion 353 is provided on a side that is opposite the side in which the convex portions 351 and 352 of the slider 3 are formed. Because a portion that bends in the left to right direction in the spring portion 54 of the retainer 5 abuts the convex portion 353 of the slider 3, it is possible to prevent the slider 3 from being pulled out or removed when the slider 3 is arranged in the first position fitted with the housing 2.

As has been described above, the left and right locking convex portions 25 and the first guide portion 26 are formed in the housing 2 that configures the connector 1 according to the present disclosure. After riding up on the left and right locking convex portions 25, the flat cable 9 is arranged rearward of the locking convex portions 25. At this time, because the flat cable 9 returns to the original shape thereof from a shape where the cable was elastically bent, the cable hits the lower wall 22 of the housing 2. Because a noise is created at this time, it is easy for a worker to recognize that the engaging portion 90 of the flat cable 9 has caught on the locking convex portion 25, and that the flat cable 9 and the connector 1 are thus fitted together. Therefore, semi-fitting between the flat cable 9 and the connector 1 can be prevented.

Note that the present disclosure according to the present specification is only one example, and thus any appropriate change that preserves the gist of the present disclosure and can easily be conceived by a person skilled in the art is within the scope of the present disclosure. Finally, the widths, thicknesses, and shapes of the portions illustrated in the drawing are illustrated schematically and are not intended to limit the interpretation of the present disclosure.

What is claimed is:

1. A connector, comprising:

a plurality of terminals aligned in a left to right direction; and a housing formed with a space into which a flat cable can be inserted from a front side to a rear side, the housing configured to support the plurality of terminals, the housing comprising a left side locking convex portion, a right side locking convex portion and a guide portion, the left side locking convex portion positioned on a left side of the plurality of terminals and protruding from a lower side of the space to an upper side of the space, the left side locking convex portion configured to catch an engaging portion formed on a left side of the flat cable, the right side locking convex portion positioned on a right side of the plurality of terminals and protruding from the lower side of the space to the upper side of the space, the right side locking convex portion configured to catch an engaging portion formed on a right side of the flat cable, the guide portion protruding from the upper side of the space to the lower side of the space and being positioned between the left and right side locking convex portions for downwardly guiding the flat cable inserted into the space, wherein the left side locking convex portion has a slanted surface formed on a right side surface thereof that extends obliquely upward and to the left, and wherein the right side locking convex portion has a slanted surface formed on a left side surface thereof that extends obliquely upward and to the right.

2. A connector, comprising:

a plurality of terminals aligned in a left to right direction;

a housing formed with a space into which a flat cable can be inserted from a front side to a rear side, the housing configured to support the plurality of terminals, the housing comprising a left side locking convex portion, a right side locking convex portion and a guide portion, the left side locking convex portion positioned on a left side of the plurality of terminals and protruding from a lower side of the space to an upper side of the space, the left side locking convex portion configured to catch an engaging portion formed on a left side of the flat cable, the right side locking convex portion positioned on a right side of the plurality of terminals and protruding from the lower side of the space to the upper side of the space, the right side locking convex portion configured to catch an engaging portion formed on a right side of the flat cable, the guide portion protruding from the upper side of the space to the lower side of the space and being positioned between the left and right side locking convex portions for downwardly guiding the flat cable inserted into the space; and a slider positioned on the front side of the housing, the slider having a hole positioned farther frontward than the space, the hole being configured to have the flat cable inserted therethrough, the slider having a pressing portion that configures an upper side edge of the hole, the slider having a guide portion positioned further downward than the pressing portion, the guide portion configuring the upper side edge of the hole and a lower side edge of the hole.

3. The connector according to claim 2, wherein a first slanted surface extending obliquely rearward and upward is formed on the front side of the housing, wherein a second slanted surface extending obliquely rearward and upward is formed on a front side of at least one of the left and right side locking convex portions, and wherein a third slanted surface extending obliquely rearward and upward is formed on a rear side of the pressing portion of the slider.

4. The connector according to claim 2, wherein an outer surface of the front side of the housing has an outer concave portion and an outer surface of the slider has an outer convex portion, the outer concave portion having a cavity, the outer convex portion configured to fit in the cavity of the outer concave portion.

5. The connector according to claim 2, wherein the pressing portion has a pressing surface that abuts the flat cable and presses the flat cable downward.

6. The connector according to claim 5, wherein the pressing portion has two adjacent surfaces, positioned on a left side and a right side, respectively, of the pressing surface and farther upward than the pressing surface.

7. The connector according to claim 6, wherein the two adjacent surfaces extend horizontally along a front and back direction, and extend to an opening of the hole.

8. The connector according to claim 6, wherein when the slider is in a first position, the two adjacent surfaces are configured to cover the left and right side locking convex portions.

9. A connector, comprising:

a housing formed with a space into which a flat cable can be inserted from a front side thereof to a rear side thereof, the housing having a lower wall defining a groove;

a slider; and a plurality of terminals arranged on an inside of the groove and aligned in a left to right direction in the space, each terminal having a connecting portion that is positioned on a rear and lower end of the housing, a strut portion that extends upward from the connecting portion, an upper arm that extends frontward from an upper side of the strut portion, a first lower arm that is positioned farther downward than the upper arm and extends frontward from the strut portion, and a second lower arm that is positioned between the upper arm and the first lower arm and extends frontward from the strut portion, wherein the housing further comprises a left side locking convex portion, a right side locking convex portion and a guide portion, the left side locking convex portion being positioned on a left side of the plurality of terminals and protruding from a lower side of the space to an upper side of the space, the left side locking convex portion configured to catch an engaging portion formed on a left side of the flat cable, the right side locking convex portion being positioned on a right side of the plurality of terminals and protruding from the lower side of the space to the upper side of the space, the right side locking convex portion configured to catch an engaging portion formed on a right side of the flat cable, the guide portion protruding from the upper side of the space to the lower side of the space and being positioned between the left and right side locking convex portions for downwardly guiding the flat cable inserted into the space, wherein the slider is positioned on the front side of the housing, the slider having a hole positioned farther frontward than the space, the hole being configured to have the flat cable inserted therethrough, the slider having a pressing portion that configures an upper side edge of the hole, the slider having a guide portion positioned further downward than the pressing portion, the guide portion configuring the upper side edge of the hole and a lower side edge of the hole, the pressing portion having a pressing surface that is configured to abut the flat cable and press the flat cable downward, wherein the pressing portion has two adjacent surfaces, positioned on a left side and a right side, respectively, of the pressing surface and farther upward than the pressing surface.

10. The connector as defined in claim 9, wherein the space into which the flat cable is inserted is between the upper arm and the first and second lower arms.

11. The connector as defined in claim 9, wherein the upper arm has a tab portion that catches in a rear wall of the housing, the tab portion being formed in a space between a front and rear end of the upper arm.

12. The connector as defined in claim 9, wherein the left side locking convex portion has a slanted surface formed on a right side surface thereof that extends obliquely upward and to the left, and wherein the right side locking convex portion has a slanted surface formed on a left side surface thereof that extends obliquely upward and to the right.

13. The connector according to claim 9, wherein the two adjacent surfaces extend horizontally along a front and back direction, and extend to an opening of the hole.

14. The connector according to claim 9, wherein when the slider is in a first position, the two adjacent surfaces are configured to cover the left and right side locking convex portions.

15. The connector according to claim 9, wherein a first slanted surface extending obliquely rearward and upward is formed on the front side of the housing, wherein a second slanted surface extending obliquely rearward and upward is formed on a front side of at least one of the left and right side locking convex portions, and wherein a third slanted surface extending obliquely rearward and upward is formed on a rear side of the pressing portion of the slider.

16. The connector according to claim 9, wherein an outer surface of the front side of the housing has an outer concave portion and an outer surface of the slider has an outer convex portion, the outer concave portion having a cavity, the outer convex portion configured to fit in the cavity of the outer concave portion.

17. The connector as defined in claim 9, wherein a front end of the first lower arm has a first slanted surface formed thereon, wherein a first contact that is configured to make contact with a lower side of the flat cable is provided on an upper end of the first slanted surface, wherein a front end of the second lower arm has a second slanted surface formed thereon, wherein a second contact that is configured to make contact with the lower side of the flat cable is provided on an upper end of the second slated surface, wherein the second contact is provided farther rearward than the first contact.

18. The connector as defined in claim 17, wherein the lower wall of the housing has a slanted surface, the first and second contacts being arranged farther rearward than the slanted surface.

19. The connector as defined in claim 17, wherein the first and second contacts are arranged in planar positions in a vertical direction.

20. The connector as defined in claim 17, wherein the first and second contacts are arranged farther upward than an upper surface of the lower wall of the housing.

* * * * *